US011304521B2

(12) United States Patent
Hornikel

(10) Patent No.: US 11,304,521 B2
(45) Date of Patent: Apr. 19, 2022

(54) ARRANGEMENT OF A PULL-OUT GUIDE, A RAIL SYNCHRONIZATION DEVICE, AND A DRIVER

(71) Applicant: Julius Blum GmbH, Hoechst (AT)

(72) Inventor: Tobias Hornikel, Tettnang (DE)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/945,005

(22) Filed: Jul. 31, 2020

(65) Prior Publication Data

US 2020/0359790 A1 Nov. 19, 2020

Related U.S. Application Data

(63) Continuation of application No. PCT/AT2019/060026, filed on Jan. 23, 2019.

(30) Foreign Application Priority Data

Feb. 1, 2018 (AT) ..... A 50100/2018

(51) Int. Cl.
*A47B 88/453* (2017.01)
*A47B 88/497* (2017.01)
(Continued)

(52) U.S. Cl.
CPC ..... *A47B 88/453* (2017.01); *A47B 88/45* (2017.01); *A47B 88/463* (2017.01); *A47B 88/497* (2017.01); *A47B 2210/0078* (2013.01)

(58) Field of Classification Search
CPC ..... A47B 88/44; A47B 88/45; A47B 88/453; A47B 88/46; A47B 88/463; A47B 88/0477; A47B 88/497; A47B 2210/0064; A47B 2210/0067; A47B 2210/007; A47B 2210/0078; A47B 2210/0083
See application file for complete search history.

(56) References Cited

U.S. PATENT DOCUMENTS 8,534,781 B2 * 9/2013 Netzer ..... A47B 88/463 312/331
8,632,141 B2 1/2014 Park et al.
(Continued)

FOREIGN PATENT DOCUMENTS

CN 103919375 7/2014
CN 104135894 11/2014
(Continued)

OTHER PUBLICATIONS

International Search Report dated Mar. 18, 2019 in International (PCT) Application No. PCT/AT2019/060026.

*Primary Examiner* — Andrew M Roersma
(74) *Attorney, Agent, or Firm* — Wenderoth, Lind & Ponack, L.L.P.

(57) ABSTRACT

An arrangement of a pull-out guide can be fastened to a piece of furniture, and the pull-out guide has a first rail, a second rail that is movably mounted on the first rail, and a rail synchronization device. The rail synchronization device includes a toothed rack connected to the first rail, a toothed wheel meshing with the toothed rack, and a bearing block connected to the second rail. The toothed wheel is rotatably mounted in the bearing block, and a driver for a drawer drive device is connected to the toothed rack of the rail synchronization device.

22 Claims, 17 Drawing Sheets

(51) Int. Cl.
*A47B 88/463* (2017.01)
*A47B 88/45* (2017.01)

(56) References Cited

U.S. PATENT DOCUMENTS

| | | | | |
|---|---|---|---|---|
| 8,668,286 | B2 | 3/2014 | Gasser | |
| 8,668,287 | B2 * | 3/2014 | Schwarzmann | A47B 88/49 312/332 |
| 8,911,038 | B2 | 12/2014 | Gmeiner | |
| 8,960,820 | B2 | 2/2015 | Chen | |
| 9,295,328 | B2 * | 3/2016 | Brunnmayr | A47B 88/47 |
| 9,788,655 | B2 * | 10/2017 | Chen | F16C 29/008 |
| 9,945,416 | B2 | 4/2018 | Lu et al. | |
| 10,143,303 | B2 | 12/2018 | Koenig et al. | |
| 10,172,459 | B2 * | 1/2019 | Chen | A47B 88/437 |
| 10,582,771 | B2 * | 3/2020 | Xu | A47B 88/493 |
| 2011/0037362 | A1 | 2/2011 | Park et al. | |
| 2012/0091872 | A1 | 4/2012 | Matthes et al. | |
| 2012/0237144 | A1 | 9/2012 | Gasser | |
| 2013/0129267 | A1 | 5/2013 | Chen | |
| 2013/0257245 | A1 | 10/2013 | Gmeiner | |
| 2014/0210329 | A1 * | 7/2014 | Brunnmayr | E05B 65/46 312/333 |
| 2014/0319986 | A1 | 10/2014 | Brunnmayr | |
| 2017/0071338 | A1 * | 3/2017 | Lu | F16C 29/045 |
| 2017/0095084 | A1 | 4/2017 | Koenig et al. | |
| 2017/0112280 | A1 * | 4/2017 | Fischer | E05F 1/02 |
| 2017/0135481 | A1 | 5/2017 | Chen et al. | |

FOREIGN PATENT DOCUMENTS

| | | | |
|---|---|---|---|
| CN | 103228180 | 3/2016 | |
| CN | 103120498 | 6/2016 | |
| DE | 20 2009 016 105 | 1/2011 | |
| DE | 20 2015 100 3 56 | 3/2015 | |
| EP | 1 036 526 | 9/2000 | |
| EP | 2 594 159 | 5/2013 | |
| EP | 2 515 710 | 2/2014 | |
| WO | 2012/068597 | 5/2012 | |
| WO | 2015/192153 | 12/2015 | |
| WO | WO-2016000003 A1 * | 1/2016 | A47B 88/463 |

* cited by examiner

ARRANGEMENT OF A PULL-OUT GUIDE, A RAIL SYNCHRONIZATION DEVICE, AND A DRIVER

BACKGROUND OF THE INVENTION

The invention concerns an arrangement comprising an extension guide that can be fastened to an item of furniture. The extension guide comprises a first rail and a second rail movably mounted on the first rail. A rail synchronization device includes a toothed rack connected to the first rail, a toothed wheel meshing with the toothed rack, and a bearing block connected to the second rail, with the toothed wheel rotatably mounted in the bearing block. An entrainment member is also provided for a drawer drive device. In addition, the invention concerns an item of furniture comprising such an arrangement.

Rail synchronization devices are usually used in order to synchronize the movement of two rail systems arranged opposite to each other on an item of furniture. As a consequence, a precise parallel guiding of a pull-out drawer is possible. This parallel guiding relative to the furniture carcass is particularly advantageous if very narrow or very broad drawers shall be moved, wherein a lateral canting of the drawer can be substantially prevented by the parallel guiding. Such systems are known to a person skilled in the art as systems for lateral stabilization. Examples are disclosed in the EP 1 036 526 A1 and in the EP 2 515 710 Bl.

Also, drawer drive devices have been known for many years by way of which a drawer is ejected or retracted. Such drawer drive devices can act directly on the drawer. Mostly, however, a so-called entrainment member is associated to the drawer or to the furniture carcass which entrainment member can be brought into engagement with the drawer drive device. An example of such a drive device is disclosed in WO 2015/192153 A1.

In the case of items of furniture which comprise a lateral stabilization and an entrainment member for a drawer drive device, the space requirement is relatively high because of the large number of necessary components. In addition, the installation can be quite complicated.

SUMMARY OF THE INVENTION

Thus, the object of the present invention is to provide an improved arrangement compared to the prior art. In particular, the space requirement shall be as low as possible. In addition, as few components and material as possible shall be needed.

According to the invention, the toothed rack of the rail synchronization device is connected to the driver (entrainment member). Thus, the toothed rack is no longer (only) connected to the first rail, but the available entrainment member is used as a connection possibility for the toothed rack of the rail synchronization device.

A first exemplary embodiment concerning the general arranging of the components of the rail synchronization device provides that the first rail is in the form of a drawer rail which can be fastened to a drawer, and the second rail is in the form of a carcass rail which can be fastened to a furniture carcass. In this case, the bearing block is associated with the carcass rail and, thus, is fixed relative to the furniture carcass, whereas the toothed racked is movable together with the drawer rail. In this exemplary embodiment, the entrainment member is associated with the drawer rail or directly to the drawer.

In the case of an alternative, second exemplary embodiment concerning the arranging of the components of the rail synchronization device the mechanic reversal is provided. This is also illustrated in the later described drawings. Accordingly, the first rail is formed as a carcass rail that can be fastened to a furniture carcass and the second rail is formed as a drawer rail that can be fastened to a drawer. In this exemplary embodiment, the entrainment member is associated to the carcass rail or directly to the furniture carcass.

For a drawer with a partial extension, it is sufficient if a rail system only comprises the first rail and the second rail. For a full extension of the drawer, a central rail can also be arranged between the first rail and the second rail.

In general, the arrangement comprises two extension guides (with a first rail and a second rail each) which can be fastened to opposite sides of the furniture carcass, as well as a rail synchronization device each and an entrainment member each. Preferably, these components of the arrangement are arranged and formed mirror-symmetrically to each other on the two sides.

According to a preferred exemplary embodiment, the rail synchronization device comprises synchronization rod which is connected to the toothed wheel and which is rotating together with the toothed wheel. This synchronization rod is connecting and synchronizing the toothed wheels arranged on opposite sides of the furniture carcass.

In general, it is possible that the toothed rack is only formed as a, preferably integrally formed, toothed bar. For an easier fastening, preferably the toothed rack comprises an elongated toothed bar—preferably oriented in the longitudinal direction of the extension guide—and a first holding element, preferably made of plastic. Particularly preferred, the toothed bar rests on the entrainment member (indirectly) by means of the first holding element.

For a simple mounting, preferably a guiding groove for the toothed bar is formed in the holding element.

In order to guarantee a connection as stable as possible, preferably the toothed bar is fixed to the first holding element in longitudinal direction. For that purpose, for example, a fixing protrusion can be formed on the first holding element.

For an even safer mounting, preferably the toothed rack comprises a second holding element, preferably made of plastic. In addition, preferably the toothed bar is connected to the first rail (indirectly) by the second holding element. This second holding element is preferably formed in such a way that it can be inserted into the profile of the first rail. Preferably, the toothed bar is guided displaceably in a longitudinal direction on the second holding element. As a consequence, tensions or bulges can be prevented.

For a simple mounting, preferably the bearing block is detachably mounted to the second rail by a, preferably lever-formed, locking element. The connection can be carried out for example by a clamping, wedging or by latching.

The entrainment member should be formed in such a way that it can be brought in engagement with the drawer drive device. For a simple manufacturing and mounting, the entrainment member preferably comprises an entrainment plate which can be connected to the first rail and an entrainment pin which is arranged on the entrainment plate. Alternatively, the entrainment plate can also be connectable directly with the furniture carcass or—in the case of a mechanical reversal—directly with the drawer.

For a good hold of the toothed bar, preferably the toothed rack rests—preferably indirectly by means of the first holding element—on the entrainment plate of the entrainment member.

A distribution package of the arrangement according to the invention does not yet necessarily include a drawer drive device. The entrainment member, however, is already part of the arrangement, even if in the assembled state this entrainment member is not needed actually. This connection of the extension guide with the entrainment member is included particularly for the reduction of storage costs if no drawer drive device at all is used in the end. However, an entrainment member is always part of the arrangement in order to have little storage effort by having fewer different variants for storage.

Preferably, the arrangement also comprises a drawer drive device which can be engaged with the entrainment member, preferably with its entrainment pin.

Particularly preferred, two drawer drive devices are arranged on opposite sides of the furniture carcass. Here, preferably these two drawer drive devices can be synchronized by a drive device synchronization device which is separate from the rail synchronization device.

Depending on the variant, the drawer drive device can be associated to the drawer or the furniture carcass. Correspondingly, the entrainment member is associated to the respective counterpart.

According to a preferred exemplary embodiment, the drawer drive device is, preferably detachably, connected with the second rail.

Moreover, preferably the drawer drive device is formed as an ejection device for ejecting the drawer from a closed position into an open position. As an alternative, the drawer drive device can be formed as a, preferably damped, retraction device for retracting the drawer from an open position into the closed position.

Further, preferably the ejection device comprises a carrier, preferably fastened to the second rail, an ejection element which is movable relative to the carrier, and an ejection force storage member which on the one hand is attached to the carrier and on the other hand is attached to the ejection element.

For a simple triggering of the ejection device, preferably the ejection device comprises a locking device which can be unlocked by over-pressing the drawer in closing direction. The locking device, for example, comprises a cardioid-shaped locking guide path with a latching recess, wherein the ejection element can be locked in the latching recess by a control pin.

Protection is also sought for an item of furniture comprising a furniture carcass, at least one drawer and an arrangement according to the invention.

BRIEF DESCRIPTION OF THE DRAWINGS

Further details and advantages of the present invention are described more fully hereinafter by means of the specific description with reference to the embodiments as illustrated in the drawings, in which.

DETAILED DESCRIPTION OF THE INVENTION

Figure 1:
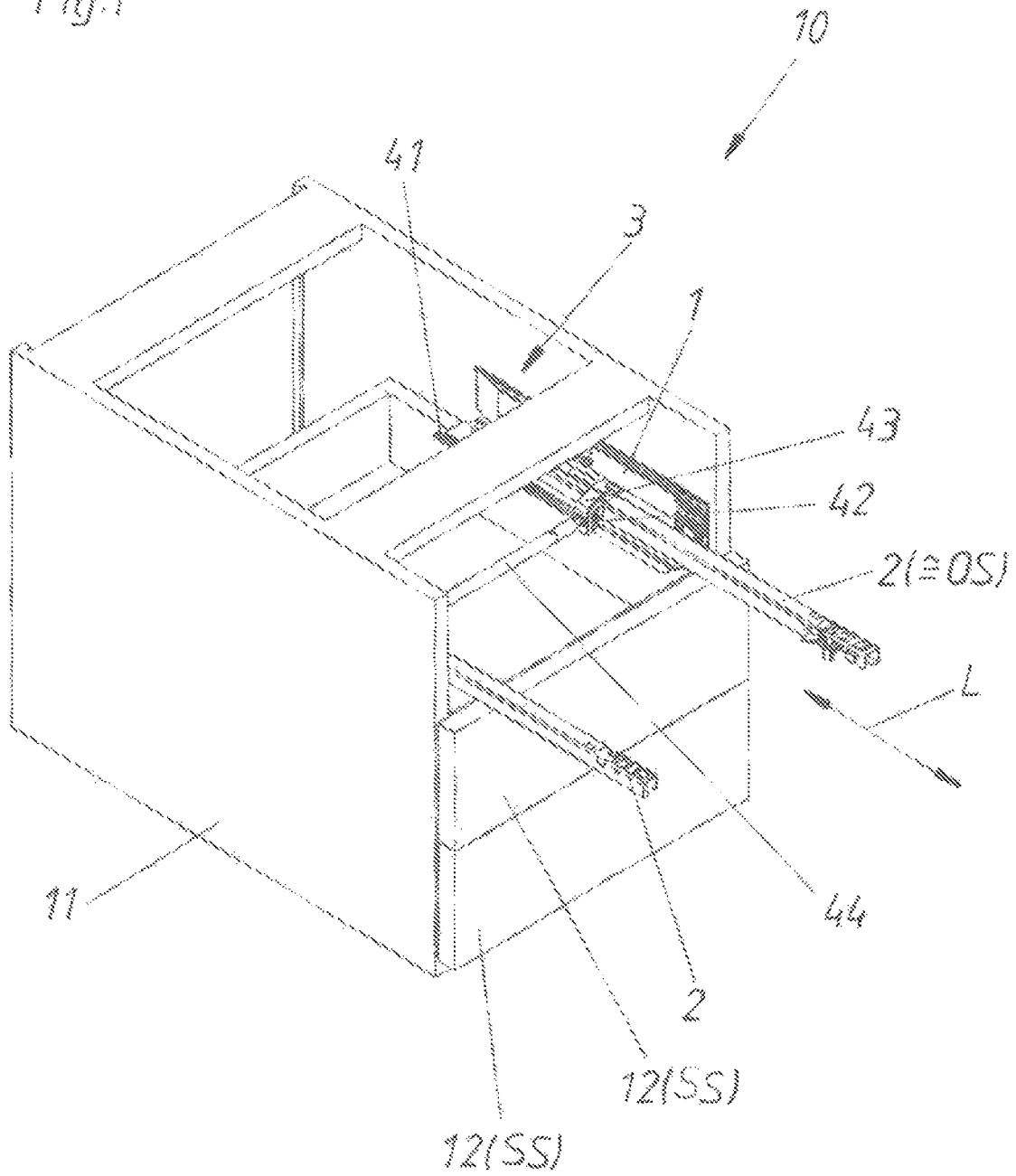
FIG. 1 is a perspective view an item of furniture with drawers and an extension guide together with a rail synchronization device.

FIG. 1 shows a perspective illustration of an item of furniture 10 with a cabinet-formed furniture carcass 11, wherein drawers 12 are movably supported by extension guides 3 (can also be referred to as rail systems) relative to the furniture carcass 11. The two below illustrated drawers 12 are each situated in a closed position SS. Concerning the upper drawer 12 (not illustrated) the second rails 2 (drawer rails) of the extension guides 3 are each situated in the extended state which would correspond to an open position OS of the drawer 12. An extension guide 3 is located on each side of the drawer 12, and the two extension guides 3 are fastened to opposite lateral walls of the furniture carcass 11. A synchronization rod 44 is shown which runs transversely to the longitudinal direction L of the extension guide 3. Preferably, this synchronization rod 44 is formed as a torsion shaft. The movements of the two extension guides 3 can be synchronized relative to each other by the synchronization rod 44, whereby a precise parallel guiding of the drawer 12 relative to the furniture carcass 11 can also be established. The two extension guides 3 each comprise a (preferably metallic) first rail 1 (carcass rail) which is to be fastened to a furniture carcass 11 as well as at least one (preferably metallic) second rail 2 (drawer rail) which is movable relative to the first rail 1 or which is movably supported on the first rail 1 respectively. The purpose of the synchronization rod 44 is to synchronize the movement of the left and right drawer rail relative to each other so that the drawer 12 can be extended from the furniture carcass 11 and can be pushed inwards without a lateral canting. The synchronization rod 44 is rotatably supported on both sides in a bearing block 43. The bearing block 43 is, preferably detachably, connected to the second rail 2. On each end region, the synchronization rod 44 has a toothed wheel 42 which meshes with a toothed rack 41. Of course, in a mechanical reversal it is also possible to support the toothed rack 41 on the drawer 12 or on the second rail 2 and to support the corresponding toothed wheel 42 together with the bearing block 43 and the synchronization rod 44 on the first rail 1 or on the furniture carcass 11. The toothed rack 41, the toothed wheel 42, the bearing block 43, and the synchronization rod 44 together form the rail synchronization device 4.

Figure 2:
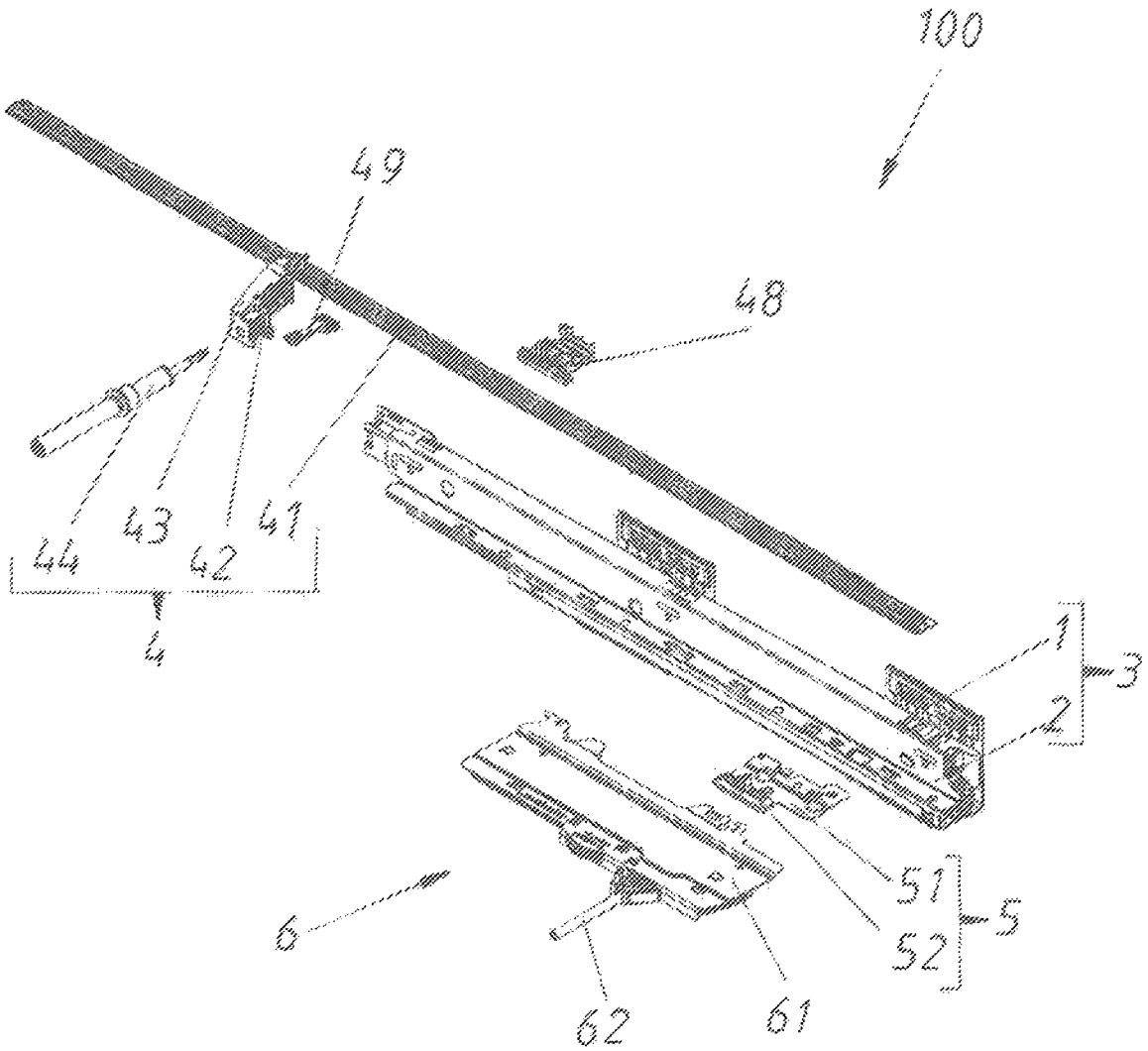
FIG. 2 is a perspective exploded view of an arrangement comprising a rail synchronization device, an extension guide, an entrainment member and a drawer drive device.

An arrangement 100 is illustrated in FIG. 2 in a perspective exploded view. This arrangement 100 comprises the rail synchronization device 4, the extension guide 3, and the entrainment member 5. In this case, the arrangement 100 additionally comprises a drawer drive device 6. The drawer synchronization device 4 comprises the only partially illustrated synchronization rod 44, the bearing block 43, the toothed wheel 42 and the toothed rack 41. In addition, the locking element 49 movably supported on the bearing block 43 is visible. Further, the second holding element 48 is visible as well. The extension guide 3 comprises the first rail 1 and the second rail 2. The entrainment member 5 comprises a, preferably metallic, entrainment plate 51 and the entrainment pin 52. The entrainment pin 52 can be formed in one piece with the entrainment plate 51. Preferably, the entrainment pin 52 is part of an attaching part, preferably made of plastic, which is connected to the entrainment plate 51. From the drawer drive device 6—which in this case is formed as an ejection device—mainly the carrier 61 is visible. In addition, this drawer drive device 6 comprises a synchronization rod 62 which is separate from the rail synchronization device 4.

Figure 3:
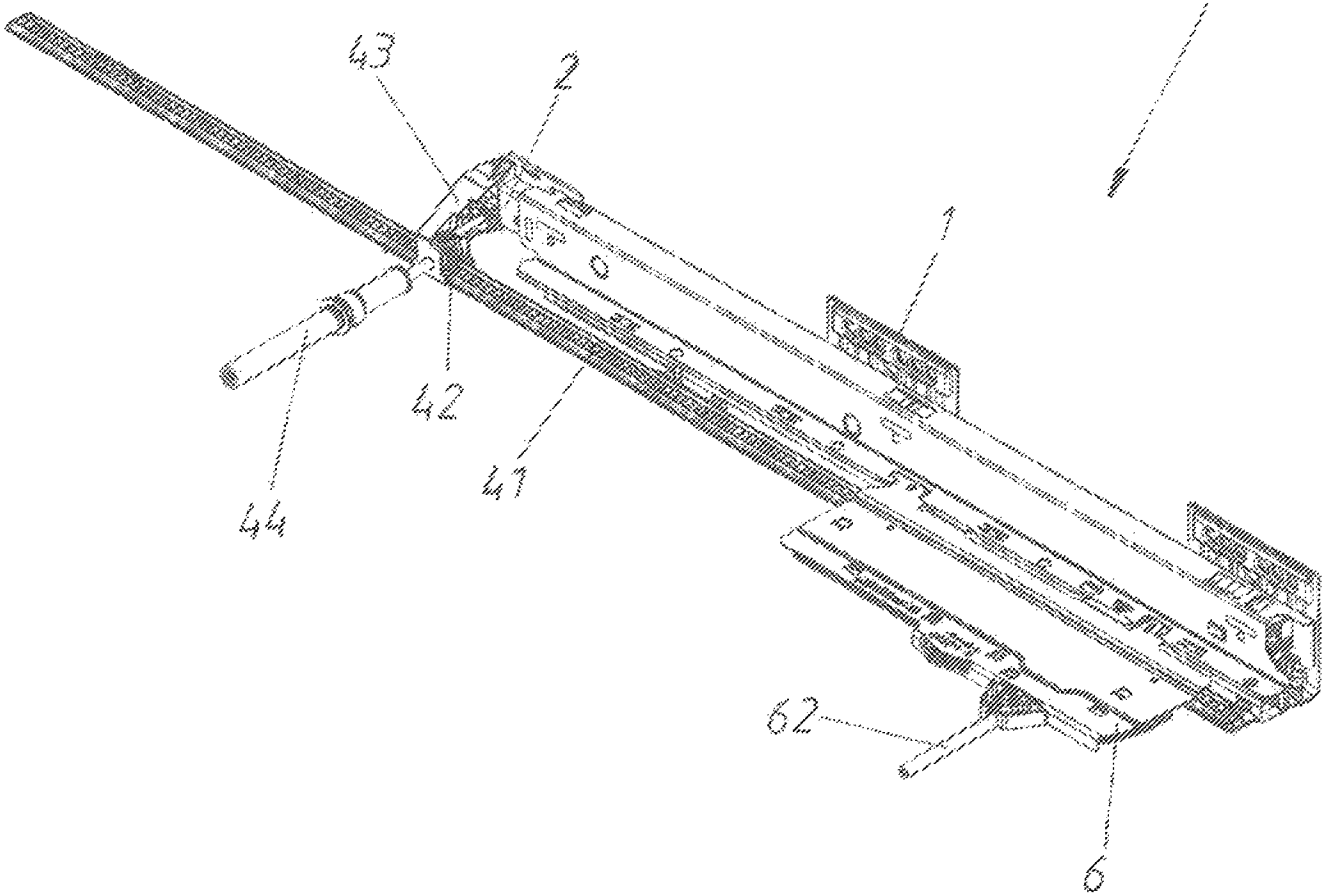
FIG. 3 shows the arrangement according to FIG. 2 in an assembled state.

In FIG. 3 the arrangement 100 is illustrated in the assembled state. The rail synchronization device 4 is fastened to a backward (rear) region of the second rail 2 by the bearing block 43. The toothed wheel 42 meshes with the (not yet cut-to-length) toothed rack 41. The drawer drive device 6 is, preferably detachably, connected with the extension guide 3 (in particular, with the container rail of the second rail 2) by the carrier 61.

In the following drawings, a possible mounting process of the arrangement 100 is illustrated step by step.

Figure 4:
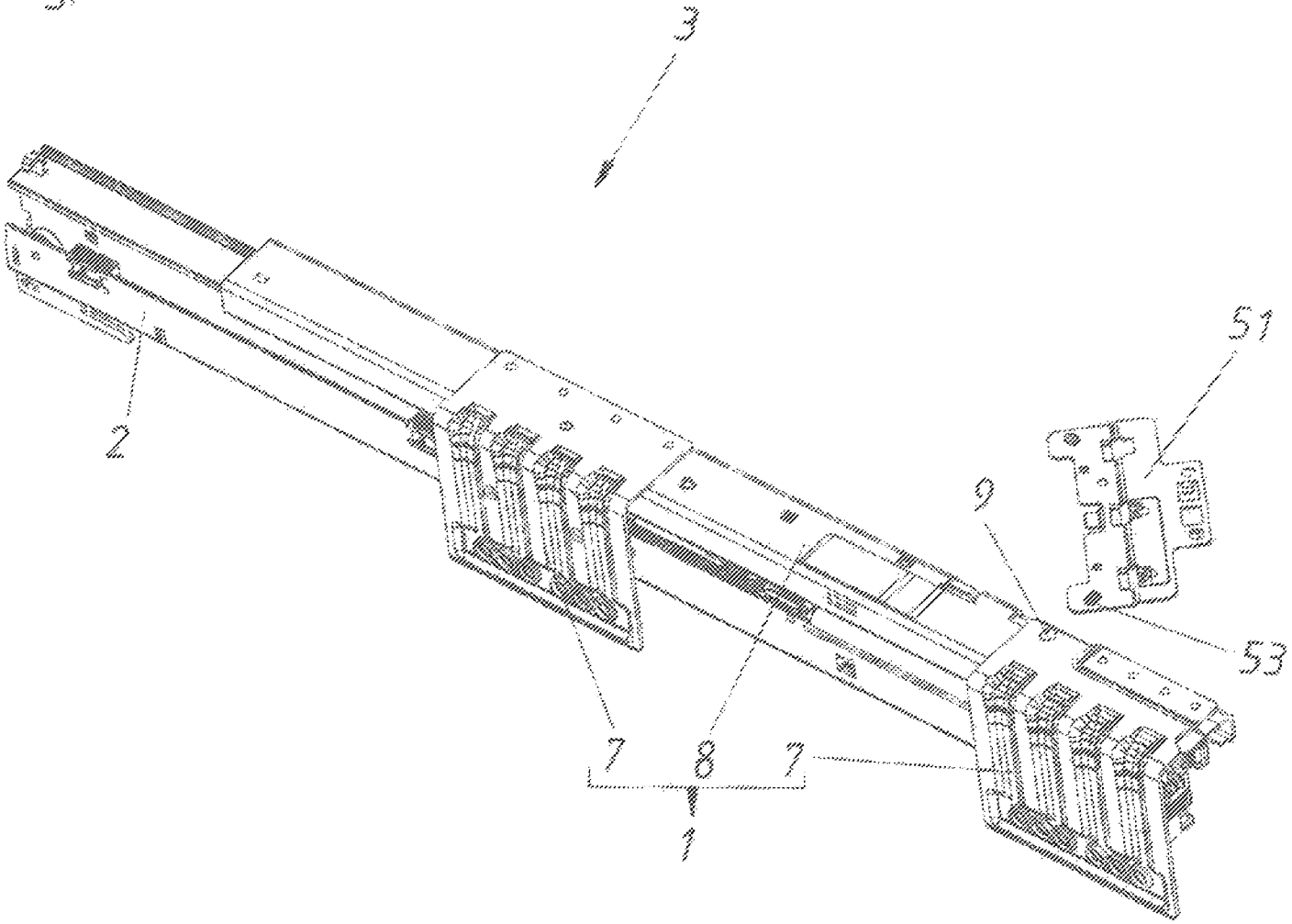
FIG. 4-16 show the mounting process of the arrangement in different perspective illustrations together with details and FIG. 17 shows the rail synchronization device in a perspective illustration.

In FIG. 4, it is initially visible that the first rail 1 comprises two angular mounting elements 7 and the rail-shaped guiding part 8. These elements are connected, preferably welded or riveted, with each other. The second rail 2 is movably supported on the guiding part 8 of the first rail by not illustrated rolls. The entrainment plate 51 is still distanced from the extension guide 3.

Figure 5:
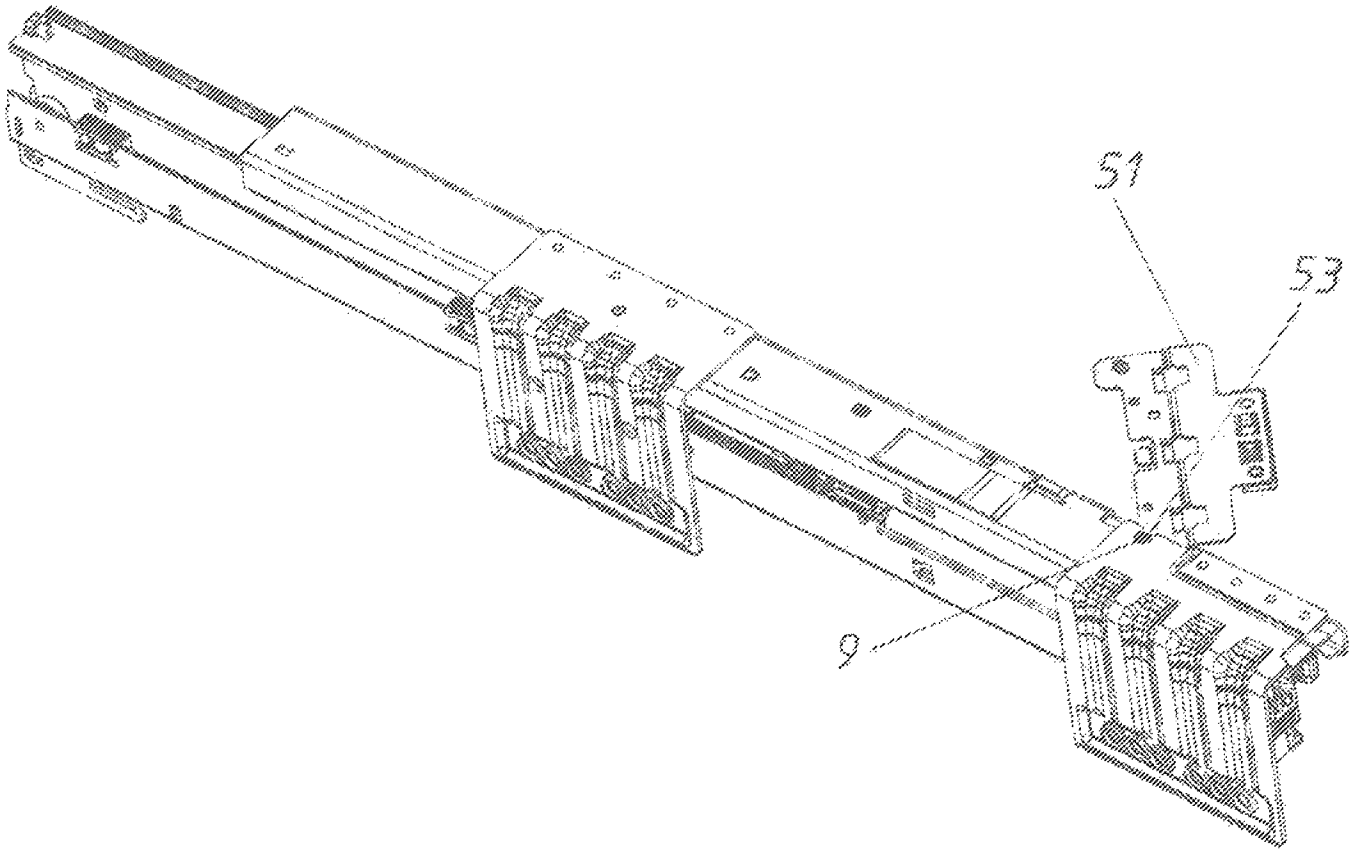

In FIG. 5, the guiding element 53 of the entrainment member 5 is inserted into the recess 9 formed in the first rail 1. In addition, the attaching part comprising the entrainment pin 52 is fastened to the entrainment plate 51.

Figure 6:
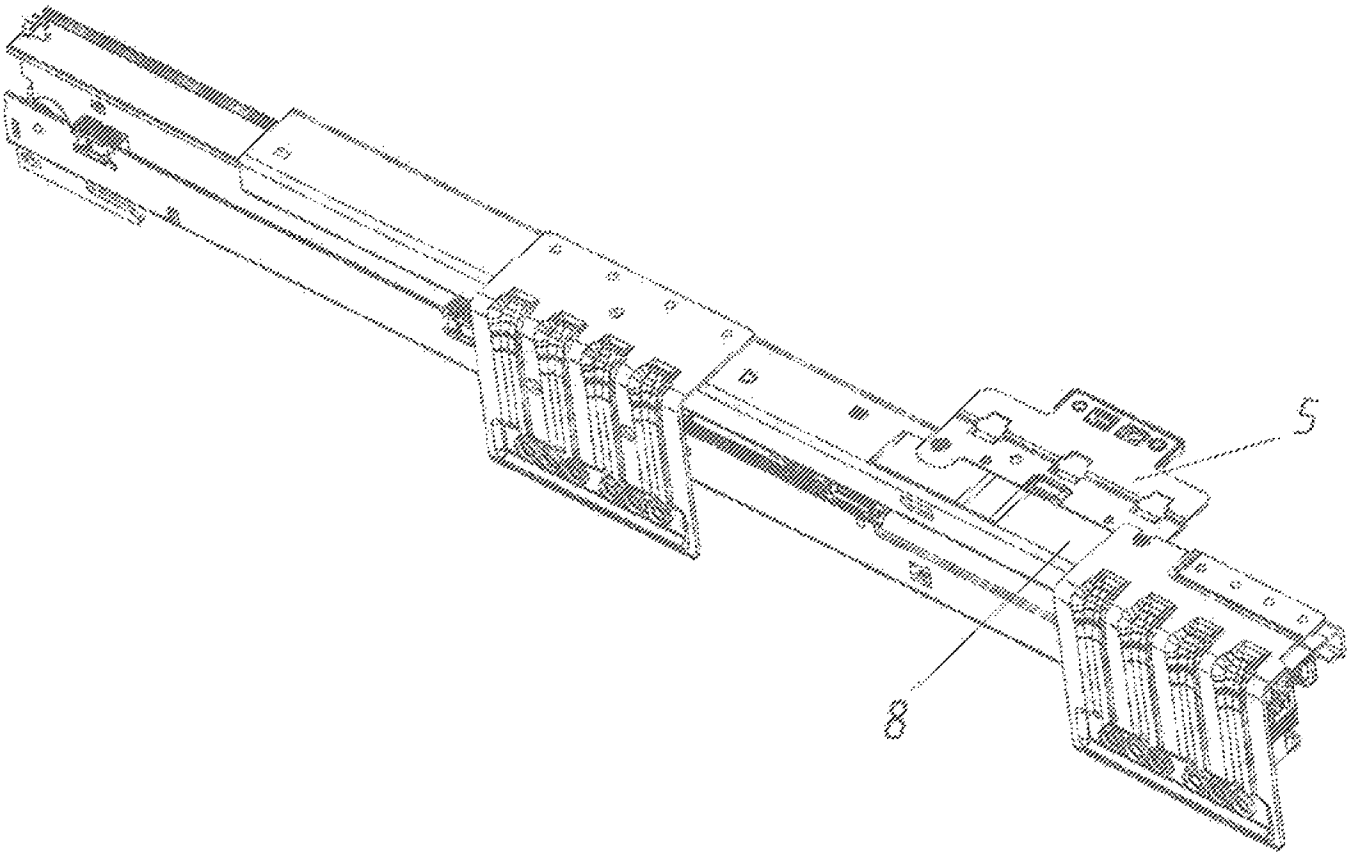

FIG. 6 shows the position after the entrainment member 5 has been swivelled relative to the extension guide 3. As a consequence, the entrainment member 5 is fastened, preferably by clamping, to the first rail 1 of the extension guide 3.

Figure 7:
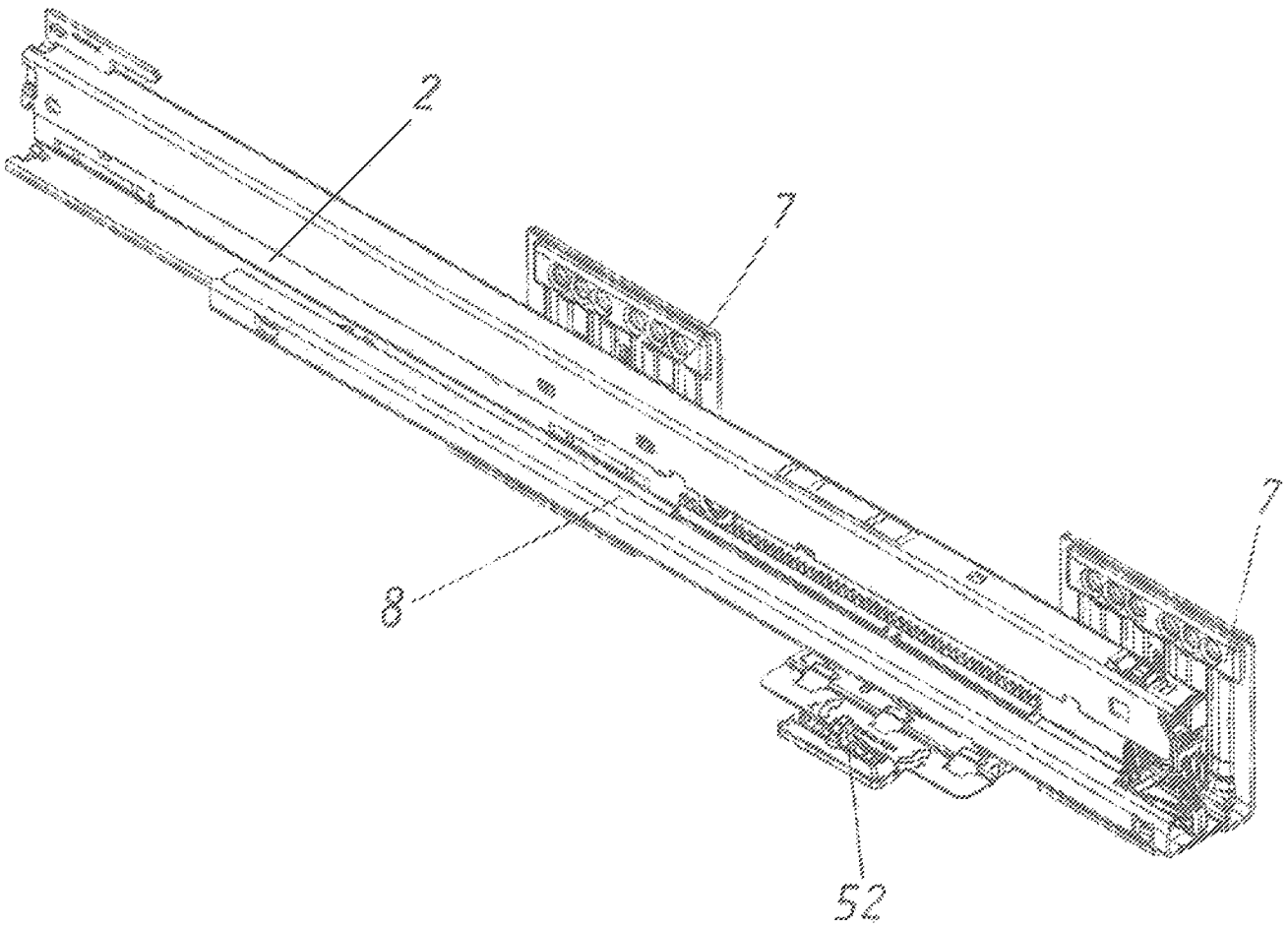

In FIG. 7, the FIG. 6 is illustrated obliquely from above. The entrainment pin 52 of the entrainment member 5 is visible as well.

Figure 8:
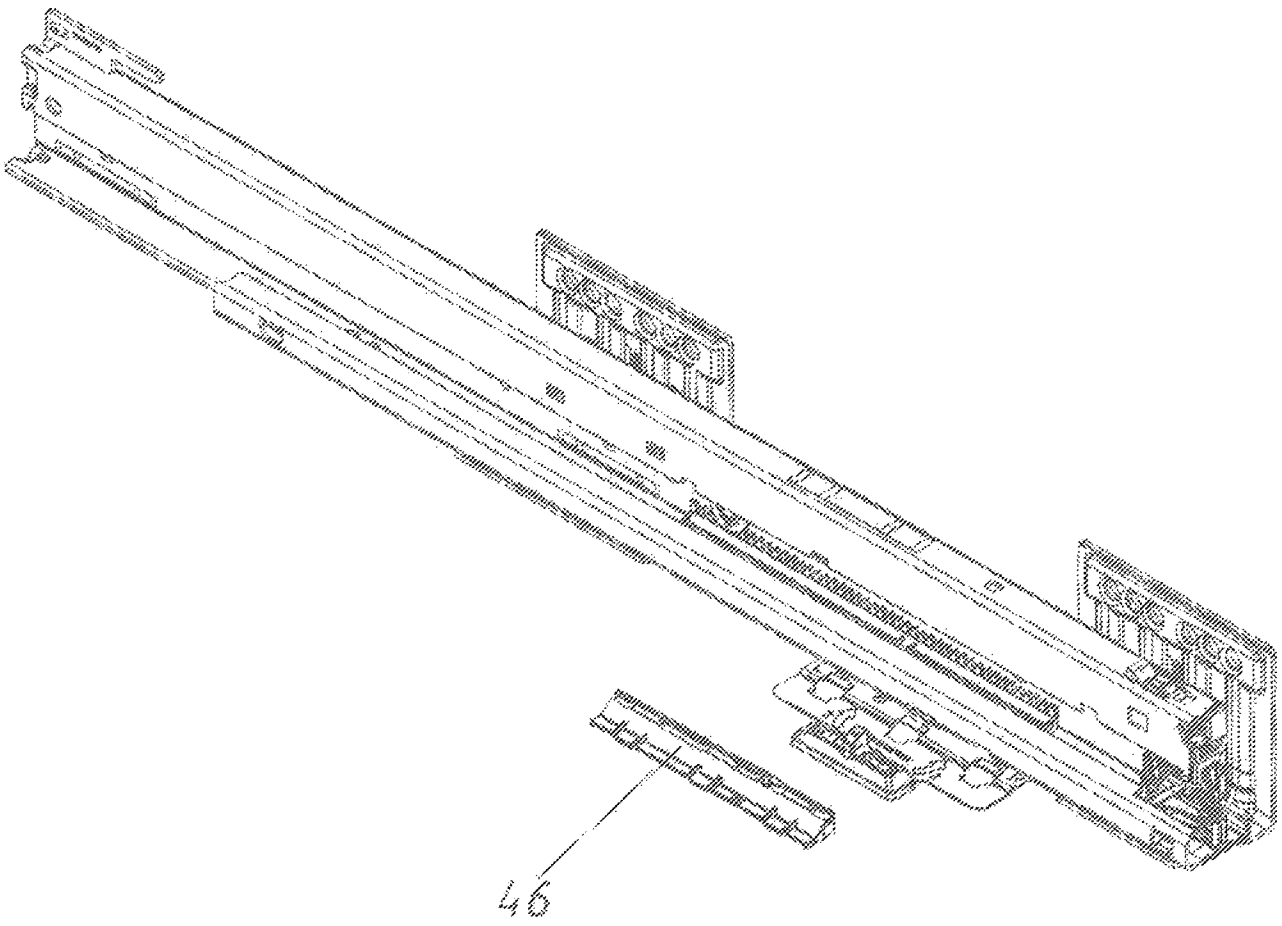

In FIG. 8, the first holding element 46, preferably made of plastic, of the rail synchronization device 4 is illustrated additionally.

Figure 9:
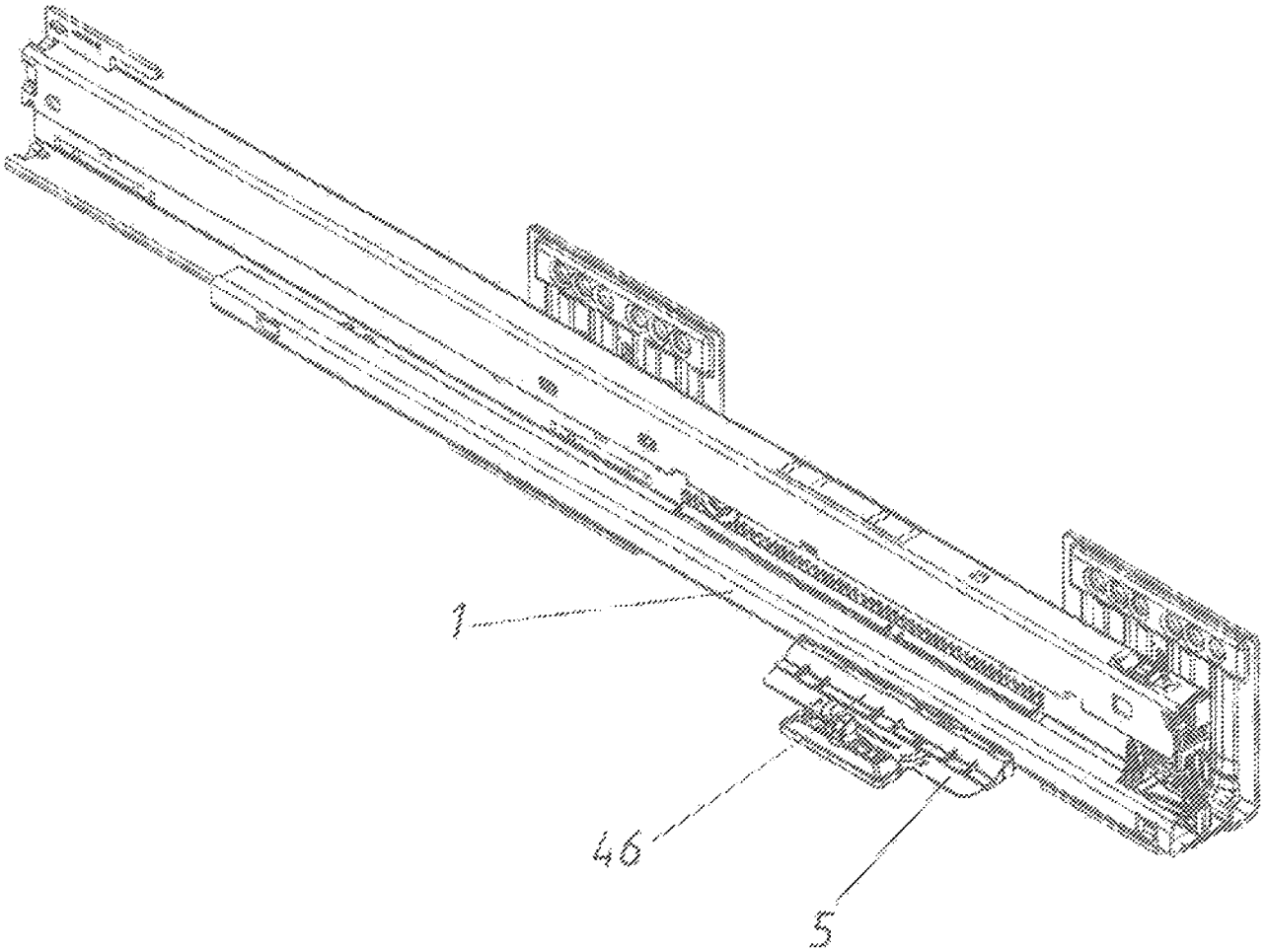

FIG. 9 shows the position when the first holding element 46 is fastened, preferably snapped or clipped, to the first rail 1 and the entrainment member 5 in the region of the entrainment member 5. As a consequence, the first holding element 46 rests directly on the entrainment member 5.

Figure 10:
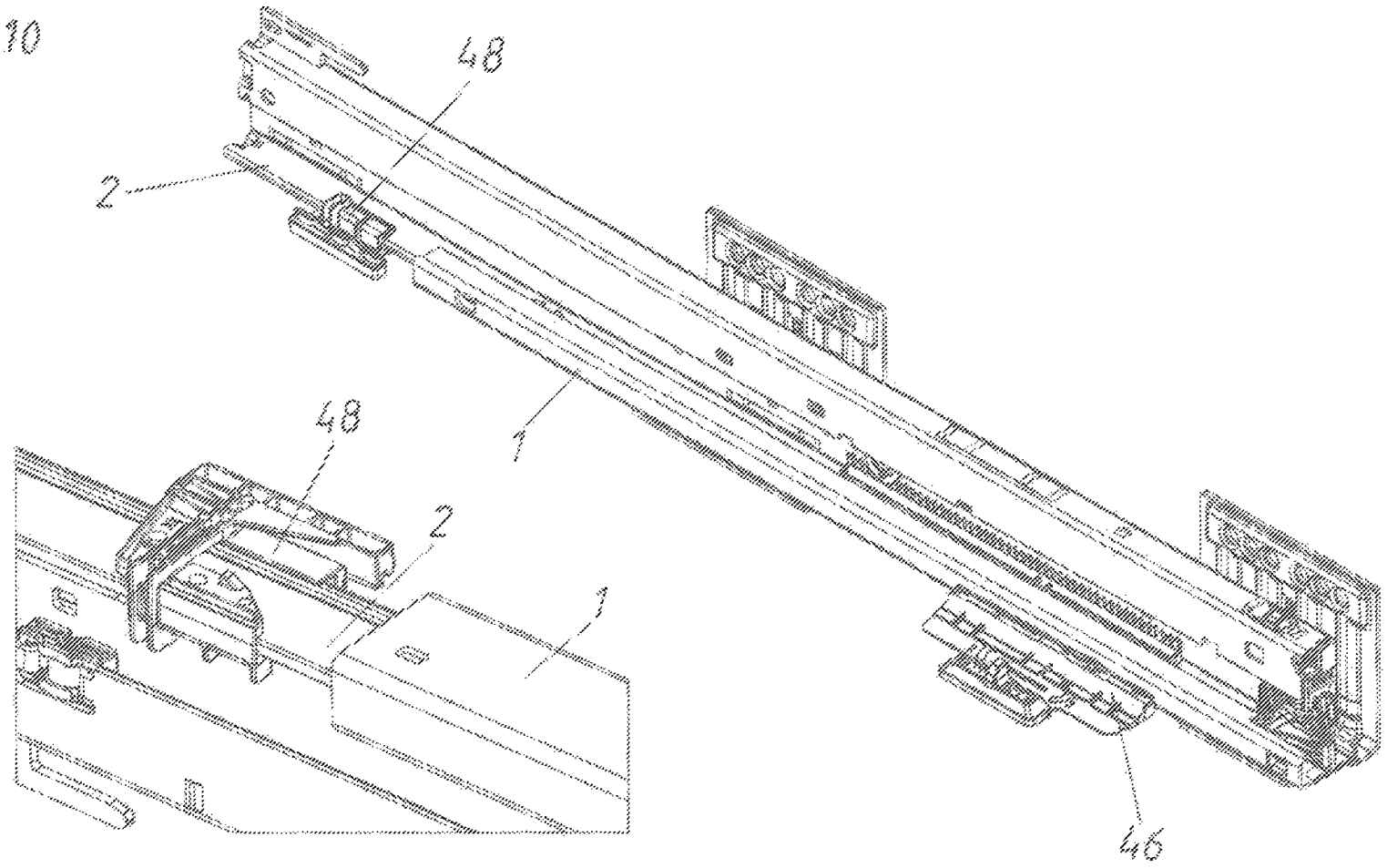

In FIG. 10, the second holding element 48 is illustrated. This second holding element 48 in this position encompasses the second rail 2. In the detail illustrated bottom left, this second holding element 48 is illustrated obliquely from below.

Figure 11:
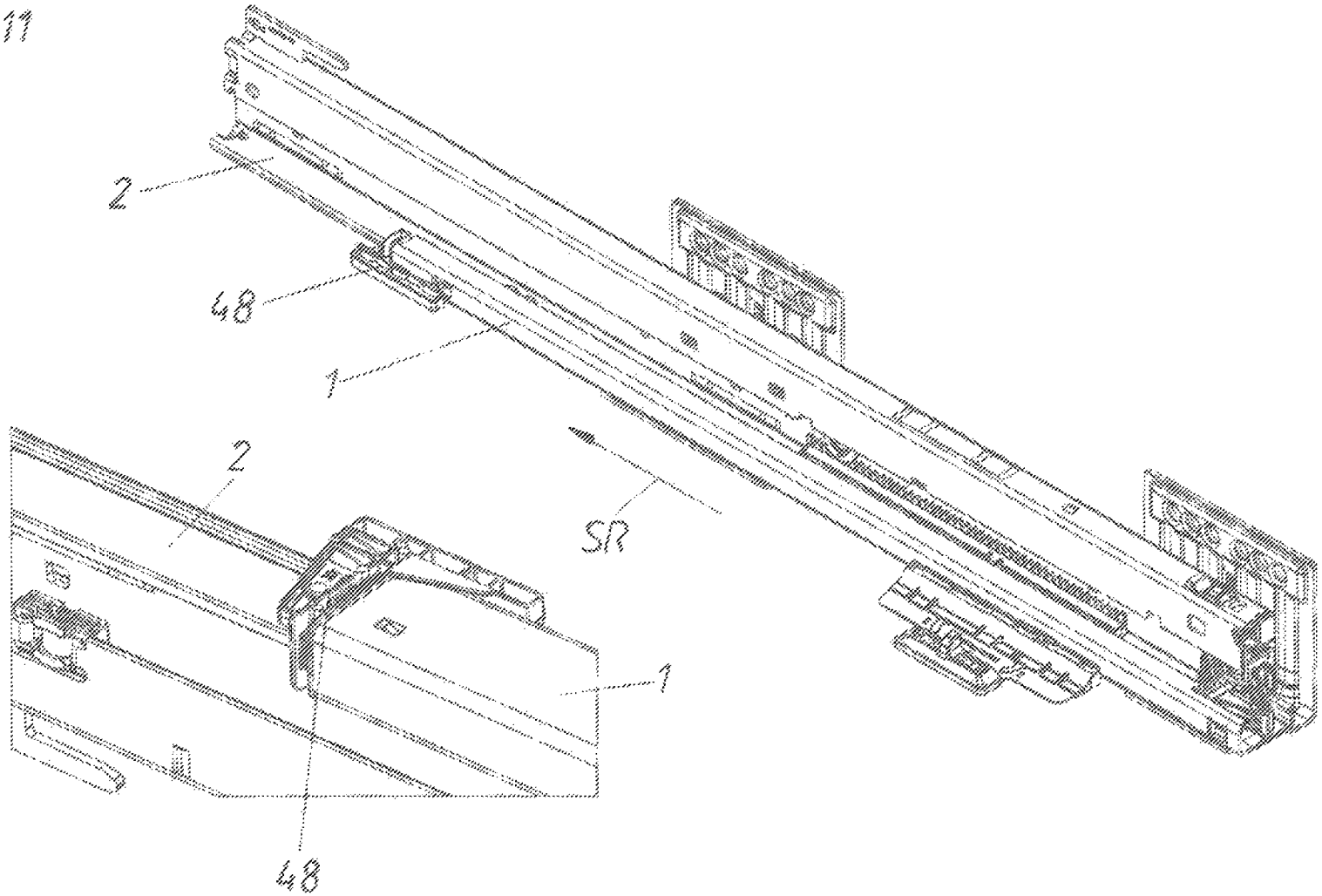

According to FIG. 11, the second holding element 48 has been shifted in longitudinal direction L opposite to the closing direction SR. As a consequence, the second holding element 48 on the one hand encompasses the second rail 2 and on the other hand is held, preferably snapped, on the end region of the first rail 1. In the detail bottom left, this is also illustrated in a view obliquely from below.

Figure 12:
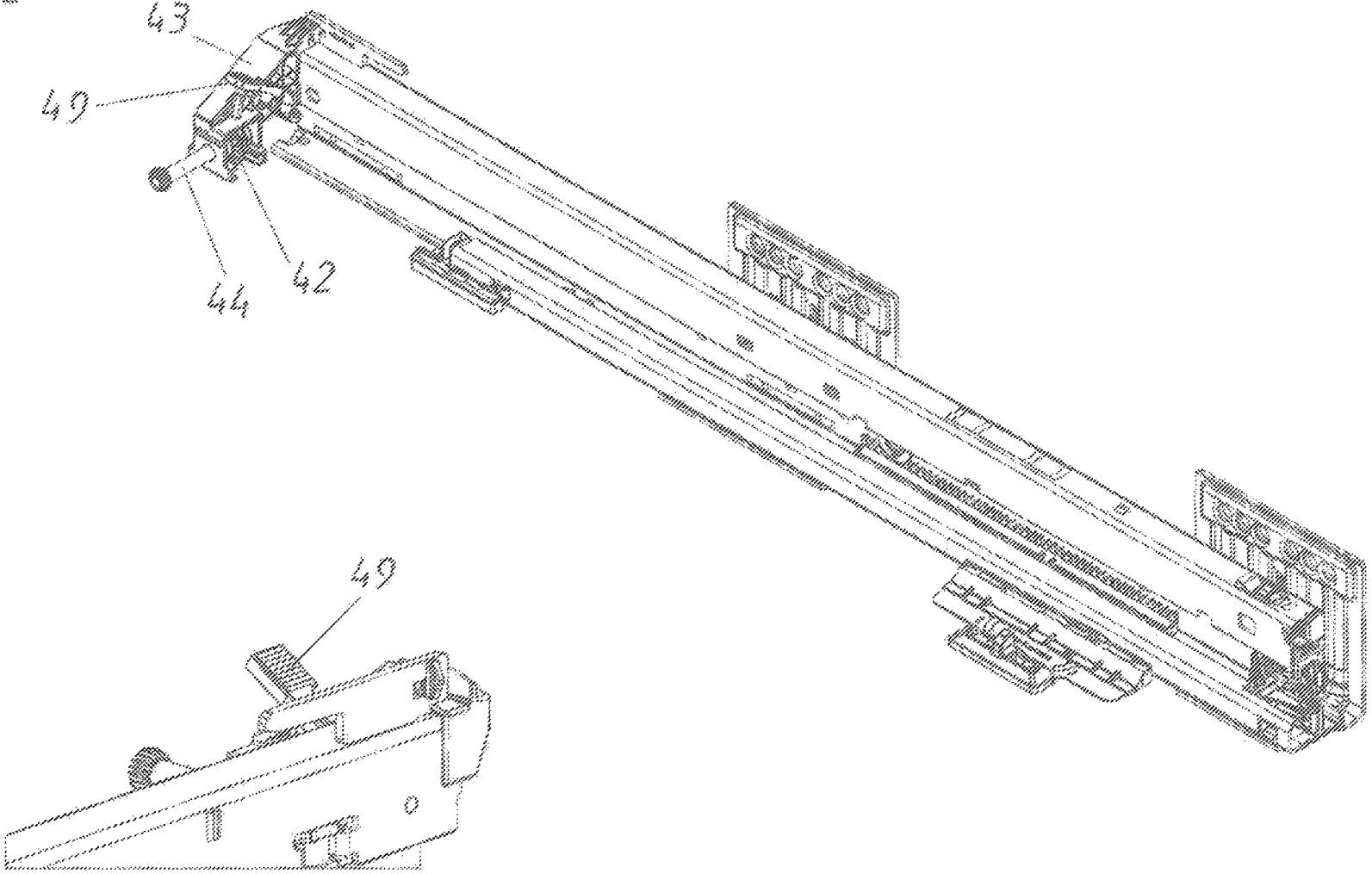

In FIG. 12, the bearing block 43 is attached to the backward region of the extension guide 3. The locking element 49 is still situated in a released position (as it is also visible in the detail bottom left).

Figure 13:
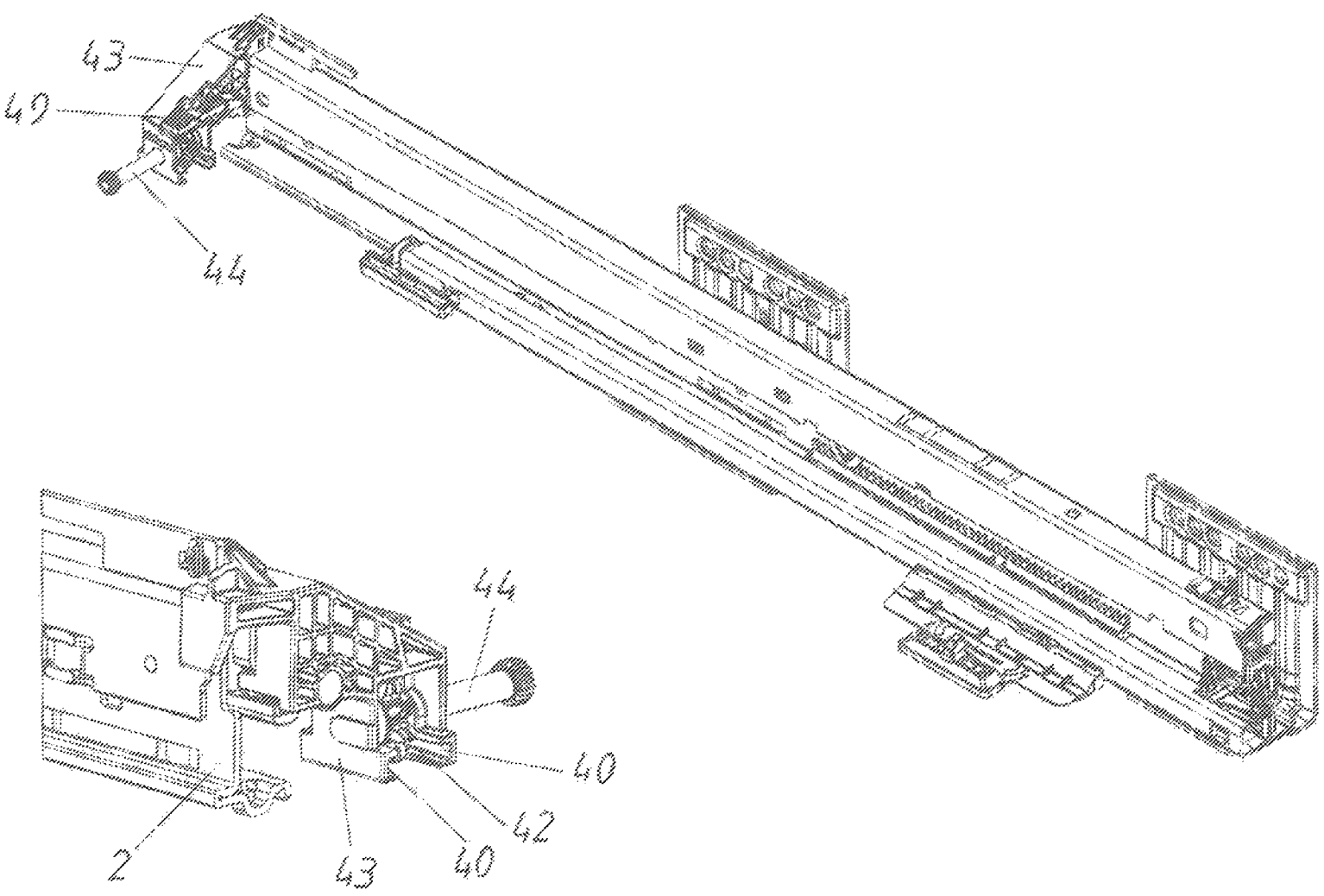

According to FIG. 13, the locking element 49 has been swivelled. As a consequence, the bearing block 43 of the rail synchronization device 4 is firmly attached to the second rail 2, and preferably clamped to the second rail 2. In the detail bottom left, this is also visible, and the synchronization rod 44 and the toothed wheel 42 (connected to the synchronization rod 44 in a torque-proofed manner) is illustrated relatively large. Also, the lateral guiding recesses 40 in the bottom region of the bearing block 43 are visible well in this detail.

Figure 14:
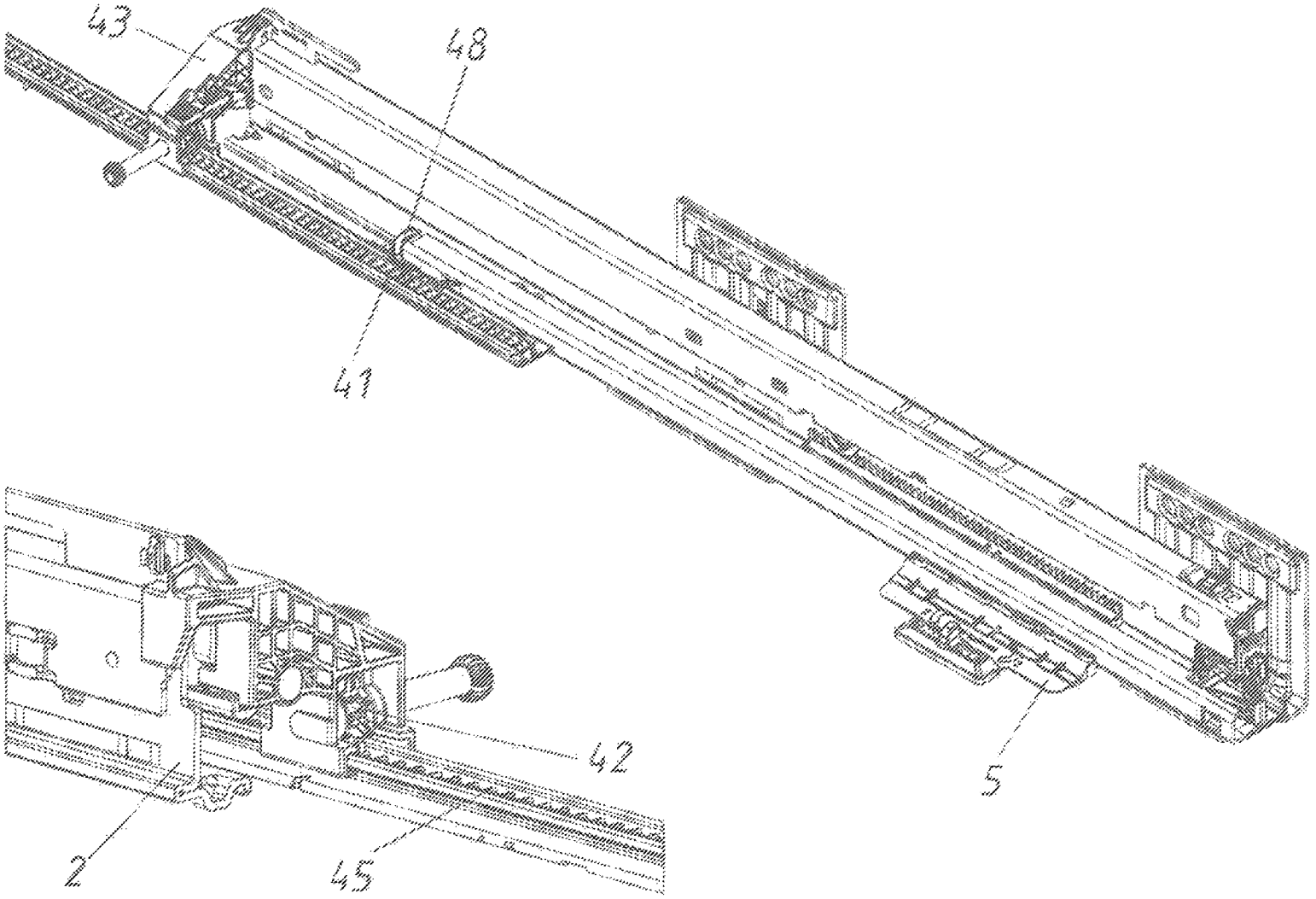

According to FIG. 14, the toothed bar 45 of the toothed rack 41 has been inserted into the bearing block 43 by the guiding recesses 40. As a consequence, the individual teeth of the toothed bar 45 mesh with the toothed wheel 42. The toothed bar 45 also already contacts the corresponding guiding recesses in the second holding element 48.

Figure 15:
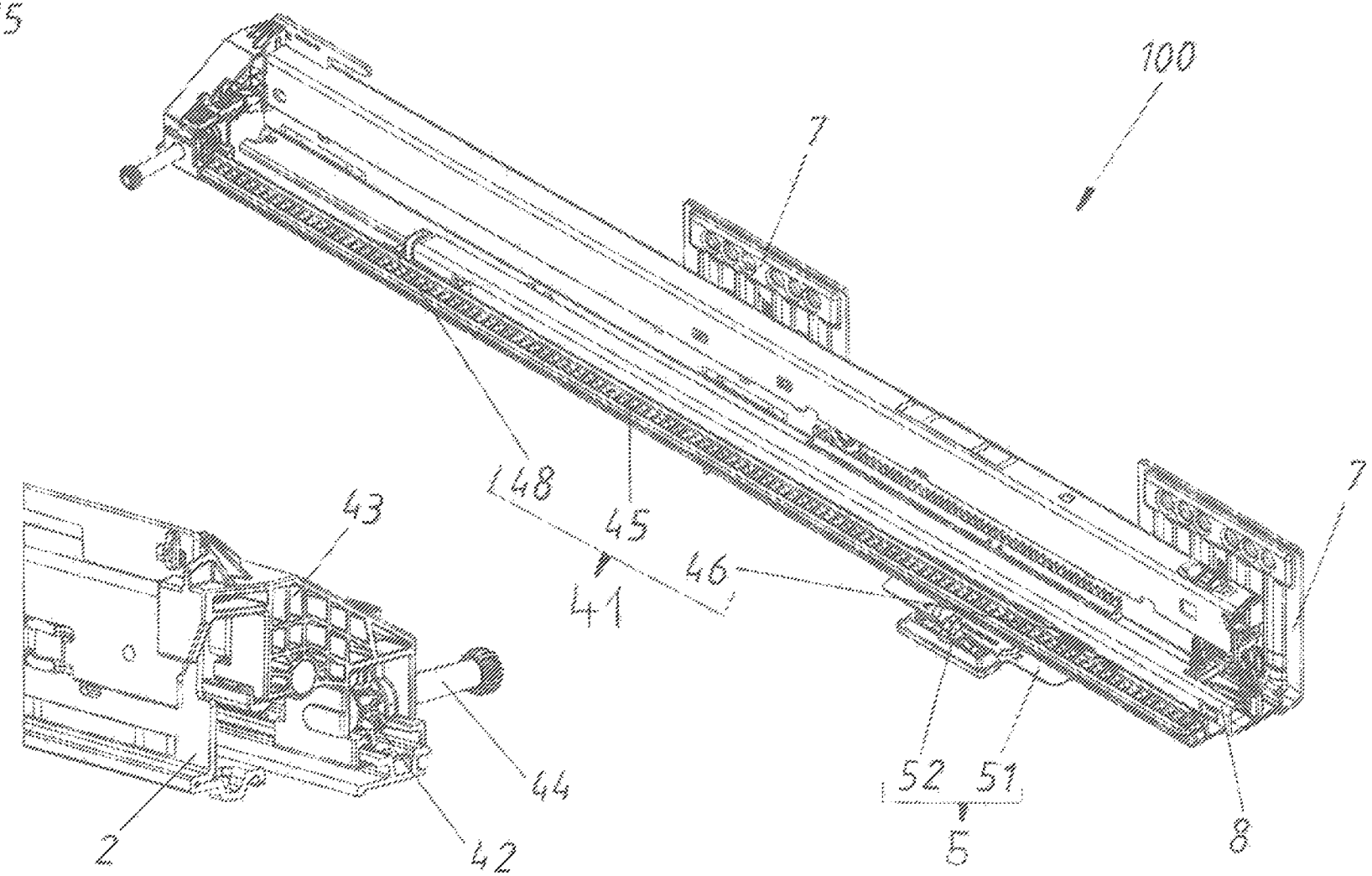

In FIG. 15, the toothed bar 45 is fully inserted into and also rests on the first holding element 46. In FIG. 15, thus, the arrangement 100 is illustrated in the assembled state. The toothed bar 45 together with the first holding element 46 forms the toothed rack 41. In this position, the toothed rack 41 of the rail synchronization device 4 is connected to the entrainment member 5. Preferably, the toothed rack 41 rests on the entrainment plate 51 of the entrainment member 5. As a consequence, no relatively complicated connections of the toothed rack 41 with the extension guide 3 must be established, and the entrainment member 5 (which is already present) is used to enable a simple mounting of the toothed rack 41 of the rail synchronization device 4. Thus, the entrainment member 5—if the arrangement 100 also comprises a drawer drive device 6—has a dual function (to support the toothed rack 41 and serve as an engagement location for the drive device).

Figure 16:
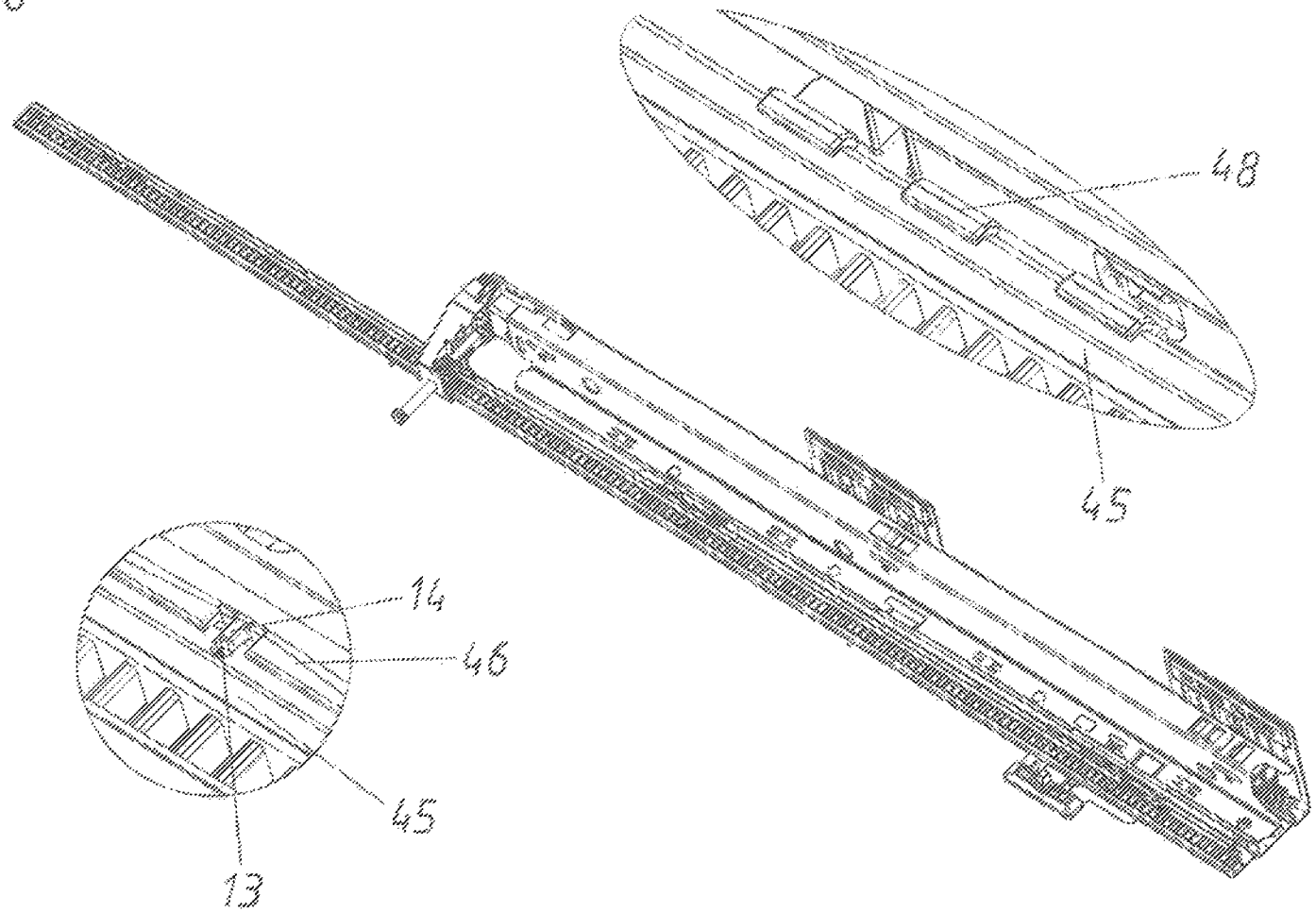

In FIG. 16 and the corresponding details, it is still visible that the toothed bar 45 is guided in a shiftable manner in the longitudinal direction in the region of the second holding element 48 (see detail top right), whereas the toothed bar 45 is fixed on the first holding element 46 of the toothed rack 41 against a movement in the longitudinal direction L (see detail bottom left). For that purpose, a latching groove 13 is formed in the toothed bar 45 and a corresponding latching protrusion 14 is formed in the first holding element 46. Where applicable, this could be formed the other way round.

Figure 17:
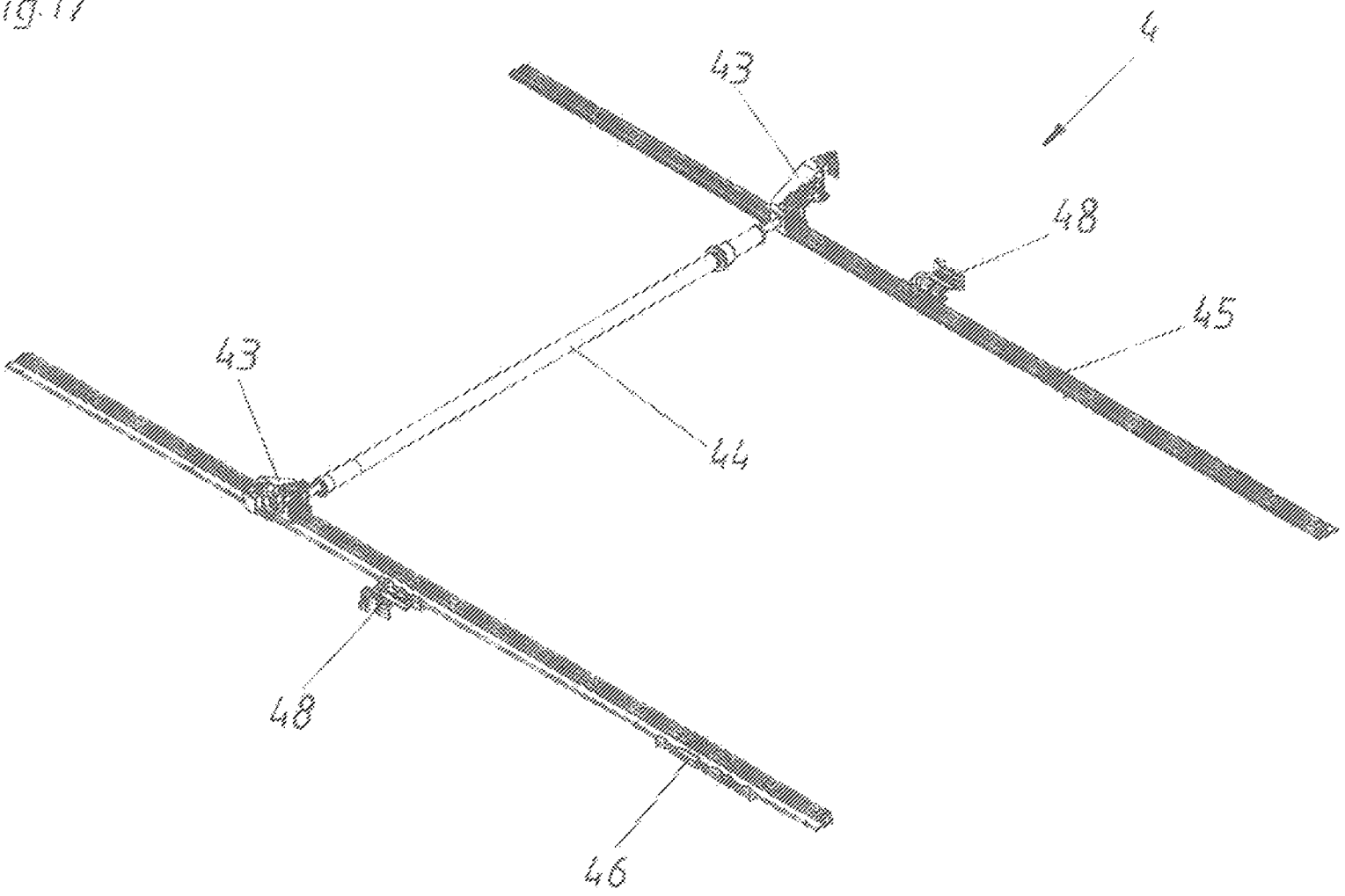

In FIG. 17, finally, the rail synchronization device 4 is illustrated without an extension guide 3. Here, the toothed racks 41 arranged on both sides (see toothed bar 45) and the bearing blocks 43 as well as the synchronization rod 44 are illustrated. By way of this rail synchronization device 4, a parallel guiding of the second rails 2 (drawer rails) of the two extension guides 3 is enabled. This is often termed as a lateral stabilization.

LIST OF REFERENCE SIGNS

1 first rail
2 second rail
3 extension guide
4 rail synchronization device
5 entrainment member
6 drawer drive device
7 mounting elements
8 guiding part
9 recess
10 item of furniture
11 furniture carcass
12 drawer
13 latching groove
14 latching protrusion
40 guiding recesses
41 toothed rack
42 toothed wheel
43 bearing block
44 synchronization rod
45 toothed bar
46 first holding element
47 guiding groove
48 second holding element

49 locking element
51 entrainment plate
52 entrainment pin
53 guiding element
61 carrier
62 synchronization rod
100 arrangement
L longitudinal direction
SS closed position
OS open position
SR closing direction

The invention claimed is:

1. An arrangement comprising:

an extension guide to be fastened to an item of furniture, the extension guide including a first rail and a second rail movably mounted on the first rail;

a rail synchronization device including a toothed rack connected to the first rail, a toothed wheel meshing with the toothed rack, and a bearing block connected to the second rail, the toothed wheel being rotatably mounted in the bearing block; and an entrainment member fixed to the toothed rack so as to be immovable relative to the toothed rack, the entrainment member comprising an entrainment plate and an entrainment pin on the entrainment plate so as to be immovable relative to the entrainment plate, the entrainment pin being configured to engage a drawer drive device, wherein the toothed rack rests on the entrainment member such that the entrainment member supports the toothed rack, and wherein the bearing block receives the toothed rack so as to support a portion of the toothed rack such that the toothed rack is free of any direct support between the entrainment plate and the bearing block.

2. The arrangement according to claim 1, wherein the first rail is a carcass rail to be fastened to a furniture carcass, and the second rail is a drawer rail to be fastened to a drawer.

3. The arrangement according to claim 1, wherein the rail synchronization device includes a synchronization rod connected to the toothed wheel so as to be rotatable together with the toothed wheel.

4. The arrangement according to claim 1, wherein the toothed rack includes an elongated toothed bar and a first holding element, the toothed bar being arranged to rest on the entrainment member by the first holding element.

5. The arrangement according to claim 4, wherein the first holding element is made of plastic.

6. The arrangement according to claim 4, wherein the first holding element has a guiding groove for receiving and guiding the toothed bar.

7. The arrangement according to claim 4, wherein the toothed bar is fixed to the first holding element in a longitudinal direction.

8. The arrangement according to claim 4, wherein the toothed rack further includes a second holding element connecting the toothed bar to the first rail.

9. The arrangement according to claim 8, wherein the second holding element is made of plastic.

10. The arrangement according to claim 1, wherein the bearing block is detachably mounted to the second rail by a locking element.

11. The arrangement according to claim 1, wherein the entrainment plate is connected to the first rail.

12. The arrangement according to claim 1, further comprising a drawer drive device for engaging the entrainment member.

13. The arrangement according to claim 12, wherein the drawer drive device is connected to the second rail.

14. The arrangement according to claim 13, wherein the drawer drive device is detachably connected to the second rail.

15. The arrangement according to claim 12, wherein the drawer drive device is an ejection device configured to eject the drawer from a closed position into an open position.

16. The arrangement according to claim 15, wherein the ejection device includes a locking device configured to be unlocked by over-pressing the drawer in a closing direction.

17. The arrangement according to claim 15, wherein the ejection device includes a carrier, an ejection element movable relative to the carrier, and an ejection force storage member attached to both the carrier and the ejection element.

18. The arrangement according to claim 17, wherein the carrier is fastened to the second rail.

19. An item of furniture comprising a furniture carcass, a drawer, and the arrangement according to claim 1.

20. An arrangement comprising:

an extension guide to be fastened to an item of furniture, the extension guide including a first rail and a second rail movably mounted on the first rail;

a rail synchronization device including a toothed rack connected to the first rail, a toothed wheel meshing with the toothed rack, and a bearing block connected to the second rail, the toothed wheel being rotatably mounted in the bearing block; and an entrainment member fixed to the toothed rack so as to be immovable relative to the toothed rack, wherein the entrainment member comprises an entrainment plate connectable to the first rail so as to support a portion of the toothed rack, and an entrainment pin on the entrainment plate so as to be immovable relative to the entrainment plate, the entrainment pin being configured to engage a drawer drive device, and wherein the bearing block receives the toothed rack so as to support a portion of the toothed rack such that the toothed rack is free of any direct support between the entrainment plate and the bearing block.

21. An arrangement comprising:

an extension guide to be fastened to an item of furniture, the extension guide including a first rail and a second rail movably mounted on the first rail;

a rail synchronization device including a toothed rack connected to the first rail, a toothed wheel meshing with the toothed rack, and a bearing block connected to the second rail, the toothed wheel being rotatably mounted in the bearing block;

a pair of drawer drive devices to be arranged on opposite sides of a movable furniture part, the pair of drawer drive devices including a synchronization rod for synchronizing an operation of the drawer drive devices; and an entrainment member fixed to the toothed rack so as to be immovable relative to the toothed rack, the entrainment member comprising an entrainment plate and an entrainment pin on the entrainment plate so as to be immovable relative to the entrainment plate, the entrainment pin being configured to engage a respective one of the drawer drive devices.

22. The arrangement according to claim 21, wherein the toothed rack rests on the entrainment member such that the entrainment member supports the toothed rack.

* * * * *